US006827208B2

(12) United States Patent
Gupta et al.

(10) Patent No.: US 6,827,208 B2
(45) Date of Patent: Dec. 7, 2004

(54) PACKAGING SYSTEM FOR SEPARATELY STORING AND DISPENSING TOGETHER SEPARATE MEDICATION COMPONENTS

(75) Inventors: Pramod Gupta, Gurnee, IL (US); Rajneesh Taneja, Gurnee, IL (US)

(73) Assignee: TAP Pharmaceutical Products Inc., Lake Forest, IL (US)

( * ) Notice: Subject to any disclaimer, the term of this patent is extended or adjusted under 35 U.S.C. 154(b) by 163 days.

(21) Appl. No.: 10/322,841

(22) Filed: Dec. 18, 2002

(65) Prior Publication Data

US 2003/0160067 A1 Aug. 28, 2003

Related U.S. Application Data

(60) Provisional application No. 60/341,936, filed on Dec. 19, 2001.

(51) Int. Cl.[7] ..... B65D 25/08
(52) U.S. Cl. ..... 206/219; 206/528
(58) Field of Search ..... 206/219–222, 206/528, 538, 539, 568

(56) References Cited

U.S. PATENT DOCUMENTS

| | | | | |
|---|---|---|---|---|
| 4,362,241 A | * | 12/1982 | Williams | 206/219 |
| 4,511,533 A | * | 4/1985 | Guadagno et al. | 206/219 |
| 4,608,043 A | * | 8/1986 | Larkin | 206/219 |
| 5,699,902 A | * | 12/1997 | Sperry et al. | 206/219 |
| 5,899,325 A | * | 5/1999 | Bertram et al. | 206/219 |
| 5,996,782 A | * | 12/1999 | Sperry et al. | 206/219 |

* cited by examiner

*Primary Examiner*—Luan K. Bui
(74) *Attorney, Agent, or Firm*—Paul D. Yasger

(57) ABSTRACT

The present invention relates to a packaging system intended to simplify the usage of multiple medications stored separately and used together, thereby minimize the non-compliant use of the multiple medications. Generally, the separate medication components are contained in a plurality of compartments, which when a deforming force is applied are released into an outer containment pouch. The medication components can then be mixed together and dispensed from the outer pouch.

24 Claims, 4 Drawing Sheets

PACKAGING SYSTEM FOR SEPARATELY STORING AND DISPENSING TOGETHER SEPARATE MEDICATION COMPONENTS

This application claims priority from U.S. Provisional Application Ser. No. 60/341,936, filed Dec. 19, 2001.

FIELD OF THE INVENTION

The invention pertains to a packaging system for separately storing and dispensing together separate medication components. More specifically, the invention pertains to a pouch package which includes multiple compartments. The multiple compartments include multiple separate medication components, that are to be used together in a dose, but are kept separate prior to usage.

BACKGROUND OF THE INVENTION

Noncompliance with prescription medications has been identified as a major health care concern in the United States. At least one study has estimated that nearly 50 percent of all drugs are not taken as prescribed. As a result an estimated $100 billion is spent annually on lost productivity and unnecessary medical costs, such as doctor visits, hospitalizations, and nursing-home admissions. A further study has estimated that noncompliance with prescription medications causes 125,000 deaths, annually.

In some instances, patient noncompliance may be unintentional. Complex medication regimens can sometimes confuse even the most alert of patients. However when coupled with reduced memory capacity like that resulting from dementia, mental illness, or even less severe natural degradations in mental facilities due to aging, patient compliance becomes that much more difficult.

In other instances, patient noncompliance may be intentional. Pain, for example from arthritis, or other physical impairments, like difficulty swallowing, can sometimes deter patients from taking their medication as prescribed. Sometimes a patient's self comparison of the perceived side effects versus the perceived benefits of taking prescribed medication may lead to a patient's voluntary medication noncompliance.

In those instances where the side effects are real, the side effects can sometimes be treated and/or minimized by supplementing the original prescription with an additional medication directed to dealing with the side effects experienced. However, any additional medications being prescribed can only contribute to the complexity of the patient's prescription medication regimen. Depending on how complex the patient's prescription regimen already is, a doctor may be reluctant to prescribe additional medications, especially where compliance issues may already exist.

In some instances after being combined, medication components can be in a less stable form and/or can have special handling or storage requirements. For example it may be necessary to refrigerate the medication until shortly before being used. This can be problematic where refrigeration facilities are not conveniently available. This is especially problematic for school aged children who do not have access to a refrigerator at school, and who are prescribed a dose which is scheduled to be taken in the middle of the day. Many schools are reluctant to store and/or dispense the medications for various practical reasons. Consequently, a parent may need to leave work and retrieve the medication from refrigerated storage to administer the dose, even if the child was otherwise capable of properly administering their own medication.

In these instances storage as separate components prior to usage may mitigate some of the stability or special handling issues (i.e. refrigeration requirements). However, requiring preparation or mixing of multiple medication components shortly prior to usage is not free from its own set of concerns.

For example, in instances where prescribed medications are used in the form of a liquid dispersion, it may be impractical to expect a user to measure the proper amounts and to properly combine the separate medication components. The use of improper amounts of one or more components can adversely affect the strength of the medication or can result in a combination having a different synergistic effect.

Alternatively, it may be difficult for the user to know if the medication components have been properly mixed, thereby assuring proper uniformity of the combined components throughout the mixture. This may be of special concern where the medication is to be applied, topically, over a relatively wide area. Additionally, the medication may need to be administered during times of patient distress, which may also unduly complicate any required measuring and mixing.

Consequently, it would be beneficial to develop a packaging system by which multiple medications or medication components can be separately stored and dispensed together, and which reduces the burdens associated with taking the multiple medications or medication components as prescribed including simplifying the proper combination and administration of the multiple medication components.

Still further, it would similarly be beneficial to develop a packaging system, where the medication components are prevented from mixing until immediately prior to usage, and are kept substantially physically isolated from the environment outside of the package system prior to dispensing.

SUMMARY OF THE INVENTION

A package system is provided for separately storing and dispensing together separate medication components. The package system provides an outer containment pouch, which includes a surrounding pouch wall defining a pouch interior. Located within the outer containment pouch, at least partially, is a plurality of compartments. Each compartment includes a surrounding barrier material, which defines an enclosed internal storage space for receiving one of a plurality of different medication components.

The barrier material of each compartment has a weak point located on a portion of the barrier wall, that is present within the pouch interior of the outer containment pouch. When a sufficient compartment deforming force is applied to the plurality of compartments, the weak point will breach thereby releasing the medication components contained within the storage space into the pouch interior of the outer containment pouch.

In one aspect of the present invention the plurality of separate compartments are coupled to the outer containment pouch in at least a pair of disparate locations. The portions of the barrier material of the plurality of separate compartments located between the pair of locations are relatively taut, so as to resist further expansion in a lateral direction. The portion of the pouch wall of the outer containment pouch located between the pair of locations includes an amount of slack, which is capable of further expansion in a lateral direction.

In at least one instance the slack in the outer containment pouch is provided by a fold in the material. In at least a further instance, the surrounding pouch wall of the outer containment pouch is buckled, while the surrounding barrier material of the plurality of compartments is relatively taut.

In a further aspect, the interior storage space of the plurality of compartments is substantially fully expanded and substantially sealed, so that any decrease in the volume of the interior storage space will increase the internal pressure of the contents against the barrier material.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
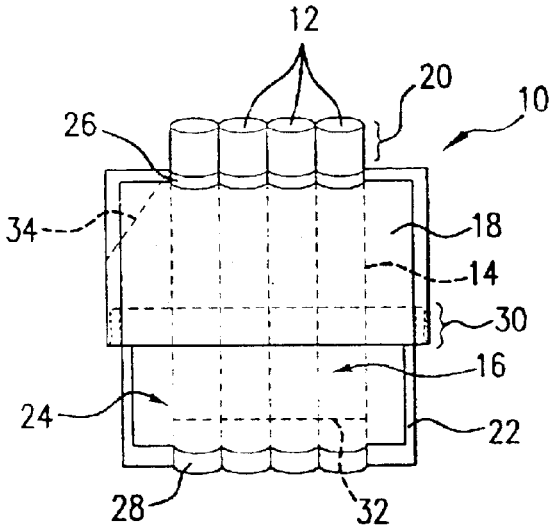
FIG. 1 is a front view of a pouch package including multiple compartments for separately storing and dispensing together separate medication components, in accordance with the present invention.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a front view of a pouch package 10 including multiple compartments 12 for separately storing and dispensing together separate medication components, in accordance with the present invention. In the illustrated embodiment, the multiple compartments 12 are each tube shape in form and has a surrounding barrier material 14, which defines an enclosed internal space 16 within which one or more different medication components can be received. The multiple compartments 12 are received within an outer containment pouch 18, with a portion 20 of the multiple compartments 12 remaining external to the outer containment pouch 18.

The outer containment pouch 18 includes a surrounding pouch wall 22, which encloses and defines a pouch interior 24.

The plurality of separate compartments 12 are coupled to the outer containment pouch 18 in at least a pair of disparate locations 26 and 28. In the illustrated embodiment the pair of disparate locations correspond to a top seam 26 of the outer containment pouch 18 and a bottom seam 28 of the outer containment pouch 18. Between the two disparate locations 26 and 28, the surrounding pouch wall 22 includes an expandable fold 30, where a portion of the surrounding pouch wall 22 folds back over itself. This allows, if necessary, for the surrounding pouch wall 22 to expand laterally. Alternatively the barrier material 14 between the disparate locations 26 and 28 is relatively taut having little ability to laterally expand without breaking, particularly in the direction that the pouch 18 is expandable. Specifically, the limited ability of the barrier material 14 to laterally expand results in the same force, that expands the pouch 18, will cause the barrier material 14 of the multiple compartments 12 to break.

Proximate the bottom seam 28, each of the multiple compartments 12 includes an area of the barrier material 14, designated by a dashed line 32, which is weakened or susceptible to tearing. A further dashed line 34 associated with the outer containment pouch 18 corresponds to the portion of the outer containment pouch 18, which is to be removed, for forming an opening through which medication components can be added or removed. Similar to the weakened area 32 of the barrier material 14, the dashed line 34 associated with the outer containment pouch 18 could also be weakened in the area of the dashed line 34 to facilitate tearing.

In at least one embodiment a weakened line or area could be made by scoring the material used to form the outer containment pouch 18 or the plurality of compartments 12. In at least another embodiment the cover sheet could be perforated along the weakened line or in the weakened area 32 or 34. In yet a further embodiment, strands of strengthening fibers could be interrupted or diminished at the points where the weakened lines/areas 32 or 34 are formed. In any event the force required to cause the outer containment pouch 18 and the plurality of compartments 12 to tear at the weakened line/area 32 or 34 is less than the amount of force required to cause a tear in the non-weakened portions of the outer containment pouch 18 and the plurality of compartments 12.

In some instances it may be inappropriate to use perforations for forming the weakened line/area. This is the case where perforations may compromise the integrity in the seal between the interior of the plurality of compartments 12 and the area outside of the plurality of compartments, where isolation of the medical component(s) from each other or the external environment is important prior to usage. In some instances, perforation of the outer containment pouch 18 may also be inappropriate. Not only is physical contact substantially prevented between elements which are sealed away from one another, but the physical isolation can include protection from humidity, light and temperature differences.

The medication component in each of the compartments 12 can take one or more of several different forms. The medication component can be in a solid form, like a powder, the medication component can be in a liquid form, or the medication component can be in a combination of the two. For example, the medication component can be in the form of a powder suspended in a liquid.

It is further possible that the medication component could be in the form of a gas or could include an element in the form of a gas. For example, the remaining space not filled with a powder or liquid could be filled with an amount of pressurized gas, that is sealed within the one or more of the compartments 12. The gas being less dense than the powder or liquid would tend to rise toward the top of the enclosed space within the compartment 12, while the powder or liquid would tend to settle in the bottom of the enclosed space. The gas being under pressure would facilitate the expulsion of the powder or liquid, when the barrier material 14 is breached at the weakened area 32 proximate the bottom seam 28.

Alternatively, the forces of gravity could be relied upon to cause the contents of the compartments 12 to empty into the outer containment pouch 18 after the compartments 12 are breached.

Once the contents of the compartments 12 or medication components are combined in the outer containment pouch 18, the medication components can be mixed together and then dispensed. Mixing can occur by shaking the outer containment pouch 18 after the medication components have emptied out of the compartments 12 and into the pouch 18.

A colorant included with the one or more medication components could be used to provide a visual indication of proper mixing. In the case where a single colorant is use, the contents of the pouch 18 could be mixed until the colorant is uniformly mixed throughout the combined contents. Alternatively, multiple colorants could be used. For example a red colorant and a blue colorant could be used to insure proper mixing, which might be evidenced by a resulting purple coloring, which is uniform in nature. The colorants could also react with other reagents unintentionally or intentionally present in the outer pouch 18 to give evidence of, for example, spoilage or other types of contamination.

By releasing the multiple medication components associated with a particular usage, to be used together at the same time, much of the confusion associated with taking multiple medications is significantly diminished. This of course requires preplanning when the medication components are packaged with knowledge as to how and when the medication components are going to be used.

While in some instances the packaging system will be highly specific to a particular user, in other instances, where the likelihood of using two or more particular medication types or components together is relatively large, the anticipated volumes may warrant making such a prepackaged combination commonly available.

There are several instances where multiple medication components, which are stored separately, but are taken together, may be beneficial. These instances include situations, where the taking of two medication components together enhance the effectiveness of one or both of the medication components. Further instances include situations, where one of the medications is being used to eliminate or reduce a side effect of the other medication. In other instances it may be beneficial to keep the two components separate until just prior to use. In some instances complete physical isolation may be desirable, while in other instances it may be sufficient to prevent the two components from coming into physical contact with one another.

Prepackaging the different medication components in the one or more multiple compartments 12 can also insure that the proper amounts of each component are mixed together. This helps to insure that the resulting mixed combination has the proper concentration or ratio of components that is deemed suitable to address the needs of the particular user. The desire to control the proper amounts of a component can even extend to a medication component, like water, as well as other medication components that are relatively inert.

Several specific examples, where multiple medication components being used together is beneficial, includes the use of certain beta blockers like propranalol, atenolol, bisoprolol and metoprolol, with certain diuretics like hydrochlorothiazide and furosemide; the use of certain nonsteroidal antiinflammatory drugs like ibuprofen, piroxicam, diclofenac, sulindac and indomethacin, with certain proton pump inhibitors like omeprazole and lansoprazole; the use of certain oral-diabetic agents like glyburide and glipizide along with metformin; and the use of certain anti-rejection drugs like cyclosporin and tacrolimus with certain types of steroids like prednisone. Various combinations of these types are well suited for use with the packaging system of the present invention.

Other specific examples that are well suited for use with the packaging system of the present invention include different types of suspensions, which include amoxacillin powder, erythromycin powder, ampicillin powder or famotidine granules.

Various flavor/sugar excipients could also be contained in one or more of the multiple compartments 12. In some instances, the flavor excipients could make a medication combination more palatable, thereby masking a bitter or pungent taste. In other instances, the flavor excipients might make the medication combination less palatable, to discourage non-prescribed usage. One skilled in the art will recognize that other combinations may be similarly suitable.

Figure 2:
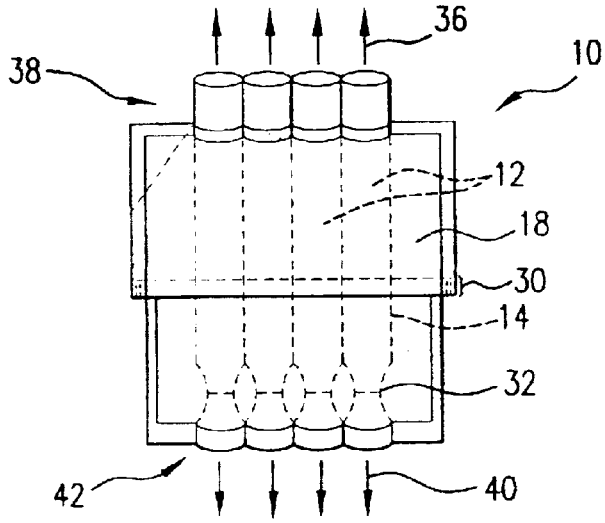
FIG. 2 is a front view of the pouch package, illustrated in FIG. 1, where compartment deforming force has been applied, partially expanding the outer containment pouch and the plurality of compartments in a lateral direction.
Figure 3:
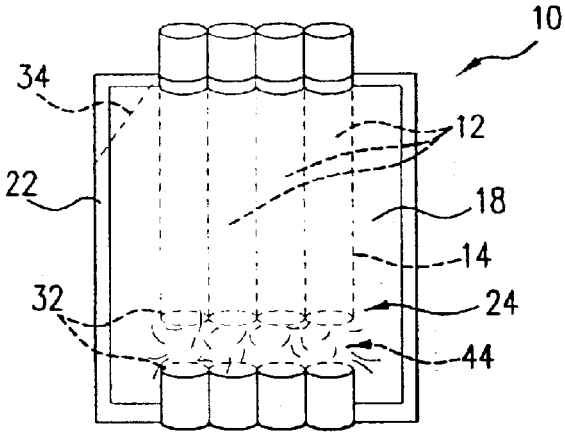
FIG. 3 is a front view of the pouch package, illustrated in FIGS. 1 and 2, where a sufficient compartment deforming force has been applied to breach the plurality of compartments.

In order to cause a breach in the multiple compartments 12, which releases the medication components into the outer containment pouch 18, generally a compartment deforming force is applied. FIGS. 2 and 3 illustrate a compartment deforming force being applied to the pouch package 10 illustrated in FIG. 1. Generally a force is applied, which attempts to expand the pouch package 10 in a lateral direction.

Specifically, FIG. 2 illustrates an expanding compartment deforming force being applied to the pouch package 10, which has partially expanded the outer containment pouch 18 and the plurality of compartments 12 in a lateral direction. Arrows 36 illustrate a first force component applied to the top portion 38 of the package 10, while arrows 40 illustrate a second counter force component applied to the bottom portion 42 of the package 10.

As the outer containment pouch 18 is expanded, the amount of material 30 remaining folded diminishes. As the already taut plurality of compartments 12 are expanded, a portion of the tube-like compartments 12, corresponding to the weakened portion 32 of the barrier material 14 necks down. At a certain point the barrier material will be unable to neck down any further, such that any further lateral expansion will result in a breach or breakage of the plurality of compartments 12.

FIG. 3 illustrates a pouch package 10, after a sufficient compartment deforming force has been applied to the pouch package 10 to cause a breach 44 to form in the barrier material 14 of the multiple compartments 12 at the weakened area 32 of the barrier material 14. The breach 44 in the barrier material 14 of the multiple compartments 12 allows the medication components contained in each of the multiple compartments 12 to be released into the pouch interior 24 of the outer containment pouch 18.

After the medication components have been released into the pouch interior 24 of the outer containment pouch 18, the medication components can be mixed together. After the components have been mixed together an opening can be made in the pouch wall 22 of the outer containment pouch 18 and the mixed contents can be removed. As noted previously, in the illustrated embodiment a portion of the pouch wall 22 has been weakened to facilitate creating the opening, for example tearing along a weakened line 34. In at least one embodiment, the amount of the mixed contents corresponds to a single dose usage.

In other instances the released medication components may not need to be mixed prior to usage, for example, in at least some instances where the released medication components are in pill or tablet form. In these instances the medication components may be used directly after they have been released without any subsequent mixing.

Figure 4:
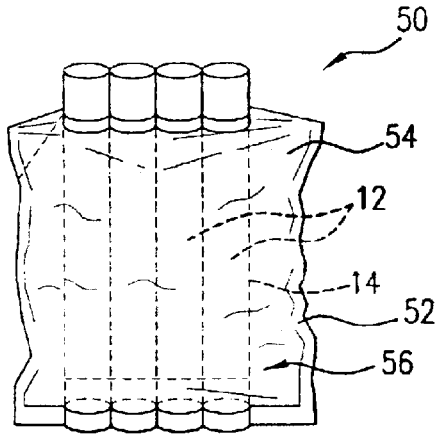
FIG. 4 is a front view of an alternative embodiment of the pouch package, illustrated in FIG. 1, where an amount of slack in the outer containment pouch is formed by buckling the surrounding pouch wall.

FIG. 4 illustrates an alternative embodiment of a pouch package 50, in accordance with the present invention, where instead of the surrounding pouch wall 22 of the outer containment pouch 18 being folded to facilitate expansion in a lateral direction, the pouch wall 52 of the outer containment pouch 54 is buckled. At the same time the barrier material 14 of the plurality of compartments 12 is maintained relatively taut.

A similar laterally extending barrier deforming force is applied to the pouch package 50, to cause a breach to occur in the barrier material 14 of the plurality of compartments 12. The contents of the plurality of compartments 12 are then allowed to be released into the pouch interior 56 of the outer containment pouch 54.

Figure 5A:
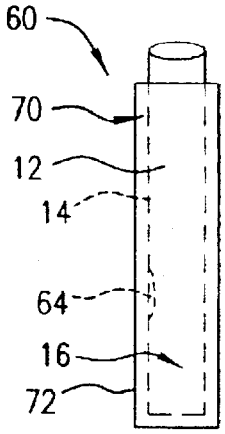
FIGS. 5A through 5C are sequential side views of a further alternative embodiment of the pouch package, where a compartment deforming force in the form of a folding force is applied by bending the pouch packet including the plurality of compartments contained therein.
Figure 5B:
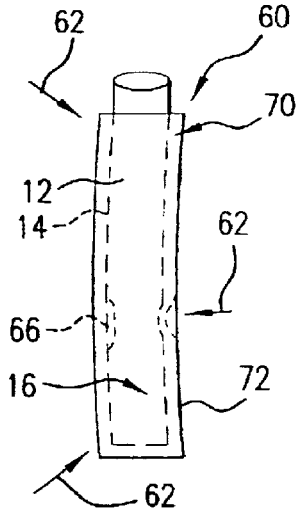
Figure 5C:
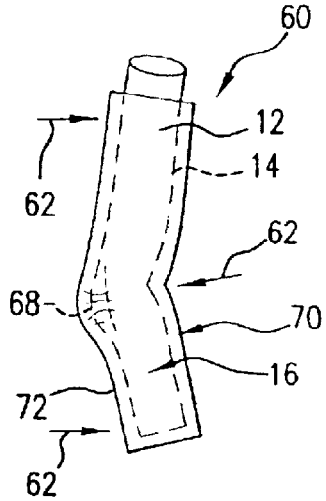

A further alternative embodiment of a pouch package 60 is illustrated in FIGS. 5A through 5C. Specifically, FIGS. 5A through 5C illustrate several side views of a compartment deforming force, in the form of a bending force 62, being applied to the pouch package 60.

The multiple compartments 12, each similarly have a weak area 64 in the barrier material 14. Each of the internal storage spaces 16 of the multiple compartments 12 is substantially sealed shut after being substantially fully expanded/inflated. To the extent that the medication component does not fill the corresponding multiple compartment 12, the remainder of the internal storage space 16 can be filled with a gas, which does not react with the other medication components. As noted previously the gas could be inserted under pressure.

As a compartment deforming force, in the form of a folding/bending force 62, is applied to the pouch package 60, each of the multiple compartments 12 are similarly folded. Folding of the multiple compartment causes the internal storage space 16 to diminish. Because the internal storage space 16 is fully expanded, any diminishment of the space 16 causes the internal pressure to increase.

FIG. 5B illustrates the beginning of the application of a folding/bending force 62. As the internal pressure increases, a bulge 66 begins to form at the weakened area 64 in the barrier material 14. As the internal pressure increases further, a breach 68 will ultimately form in the barrier material 14 of each of the multiple compartments 12, thereby allowing the contents of the multiple contents 12 to be released into the pouch interior 70 of the outer containment pouch 72, as shown in FIG. 5C. The specific location of the weakened area can be positioned at any point along the surface of the barrier material 14, so long as the resulting breach releases the medication components into the outer containment pouch 72.

Figure 6:
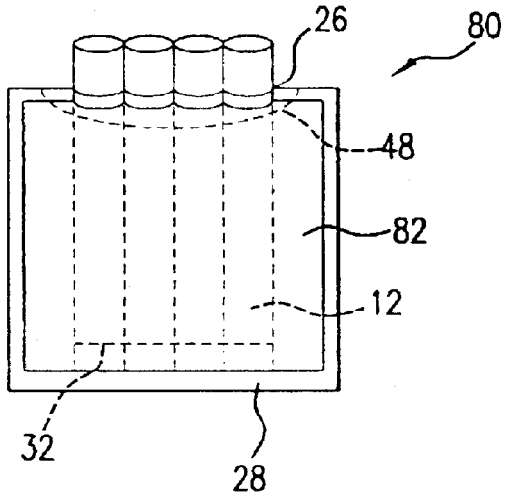
FIG. 6 is a front view of a further alternative embodiment including a perforated or weakened outer containment pouch.
Figure 7:
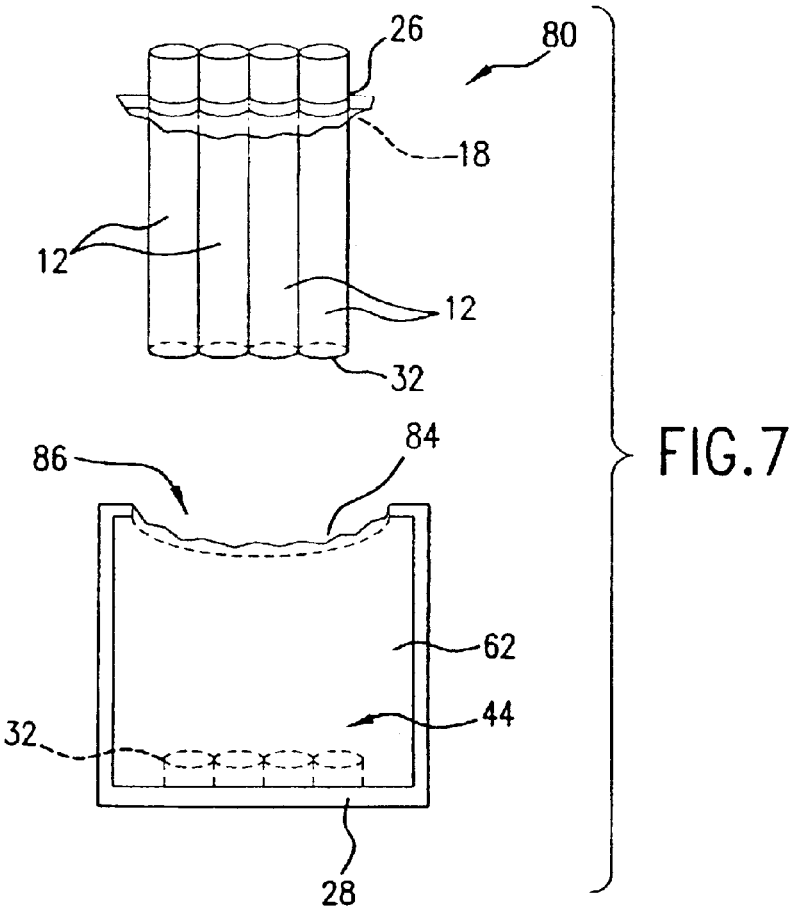
FIG. 7 is a front view of the pouch package, illustrated in FIG. 6, where a sufficient compartment deforming force has been applied, causing a portion of the outer containment pouch to tear away with a portion of the plurality of compartments, thereby releasing the medication components contained in the plurality of compartments.

FIGS. 6 and 7 illustrate a still further embodiment of a pouch package 80, where instead of the weakened line/area 34 being located at one of the corners of the outer containment pouch 82 of the pouch package 80, the weakened line/area 84 encompasses the portion of the top seam 26, of the two disparate locations 26 and 28, where the multiple compartments 12 are coupled to the outer containment pouch 82.

When a lateral extending compartment deforming force is applied to the pouch package 80, similar to the force illustrated in FIG. 2, not only is a breach caused to occur in the multiple compartments 12, but an opening 86 is created in the outer containment pouch. The released contents of the multiple compartments 12 can then be swirled together and then dispensed through the opening 86 in the outer containment pouch 82.

Figure 8:
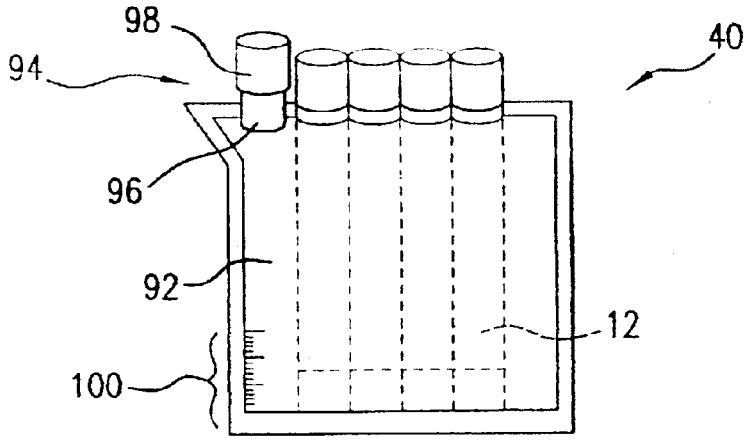
FIG. 8 is a front view of a pouch package further including an outer containment pouch with a resealable opening through which one or more medication components can be added or removed.

FIG. 8 illustrates a still further embodiment of a pouch package 90, where instead of an opening being formed in the outer containment pouch 92 by tearing along a weakened area or line 34, the outer containment pouch includes a resealable opening 94 through which medication components can be added or removed.

In the illustrated embodiment, the resealable opening 94 is in the form of circular neck 96 and a corresponding cap 98. Both the circular neck 96 and the cap 98 can be threaded to facilitate the secure attachment of the cap 98 to the neck 96. Alternatively the seal can be formed by a cap which snaps on. Still further the resealable opening 94 could be formed by a pair of interlocking closure strips of the type found on food storage bags. Other types of resealable openings are similarly possible, which one skilled in the art will readily recognize could similarly be used without departing from the teachings of the present invention.

As previously noted, not only can mixed medication components be removed from the outer containment pouch 92, via the resealable opening 94, but medication components can also be added. This would allow amount of a readily available medication component, like for example water, to be added by a user from supplies available to the user. One or more lines 100 printed on the side of the outer containment pouch 92 provide a measurement line, which enables the user to determine how much of the medication component to add. In at least the present instance, it may be beneficial for a portion of the outer containment pouch to be at least semi-translucent so that the user can determine when the added amount reaches the desired line.

Where for example water makes up a large percentage of the mixed medication, allowing the water to be added by the user will minimize the area taken up by the medication pouch prior to usage. Furthermore, it would allow a component, which has been separately heated, or alternatively cooled, to be added without requiring the entire pouch package and the contents thereof to be directly heated or cooled.

Generally the pouch package is formed using well known food safe materials. These food safe materials not only include the materials from which the outer containment pouch 18 and the plurality of compartments 12 are formed, but also the glues/adhesives used to bond or seal the various elements together. Preferably some of the materials include an outer surface upon which information can be printed. This could include the surfaces upon which any lines used for measurement of an added component are printed. Presumably, the printing materials, including the ink and/or pigments used to print the information onto the outer containment pouch 18 and/or plurality of compartments 12, are also food safe.

In addition to or in alternative to measuring lines, information printed on the pouch package can include usage instructions, like how to mix the medication components, and/or the frequency of use including the time of day and the day of the week the particular dosage should be used. The information can also include patient information, or information specific to the type of medication contained within the pouch package.

As noted previously, portions of both the outer containment pouch and the multiple compartments can be weakened, thereby facilitating the formation of breaches in the multiple compartments, when a sufficient deforming force is applied, and openings in the outer containment pouch, when a tearing force is applied. While the weakened area/lines can be created by scoring or perforating the materials used to form the surrounding pouch wall of the outer containment pouch and the barrier material of the multiple compartments, the diminishment or interruption of strengthening fibers have been identified as also being possible.

Figure 9:
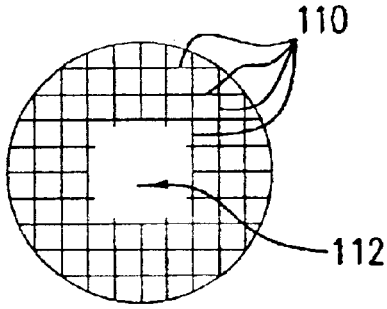
FIG. 9 is an enlarged partial plan view of a reinforcing mesh including a void corresponding to a weak area for use in either the surrounding pouch wall of the outer containment pouch or the surrounding barrier material of the plurality of compartments.
Figure 10:
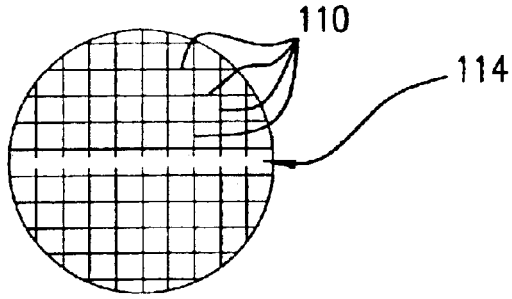
FIG. 10 is an enlarged partial plan view of an alternative embodiment of a reinforcing mesh including a break in the strands along a line defining a weak area.

FIGS. 9 and 10 illustrate examples of forming a weakened area or line, where reinforcing/strengthening fibers have been used. For example, in FIG. 9, an interruption/diminishment in the strengthening fibers 110 is illustrated that corresponds to an area 112. This form of interruption/diminishment of strengthening fibers 110 is particularly useful for use in a pouch packet like the type illustrated in FIGS. 5A through 5C, where due to internal pressures the barrier material 14 initially bulges 66, and ultimately breaches 68.

FIG. 10 alternatively illustrates an interruption/diminishment in the strengthening fibers 110, which is arranged in a line 114, so as to facilitate tearing along the line 114, when a tearing or stretching force is applied. This form of interruption/diminishment of strengthening fibers 110 is particularly useful for use in a pouch packet like the type illustrated in FIGS. 1 through 4.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A package system for separately storing and dispensing together separate medication components comprising:

an outer containment pouch including a surrounding pouch wall defining a pouch interior; and a plurality of separate compartments partially located within the outer containment pouch, each compartment including a surrounding barrier material defining an enclosed internal storage space for receiving one of a plurality of different medication components, the barrier material of each compartment having a weak point located on a portion of the barrier wall, that is present within the pouch interior of the outer containment pouch, which will breach thereby releasing the medication components contained within the storage space into the pouch interior of the outer containment pouch, when a sufficient compartment deforming force is applied to the plurality of compartments.

2. The system in accordance with claim 1 wherein the plurality of separate compartments are coupled to the outer containment pouch in at least a pair of disparate locations, where the portions of the barrier material of the plurality of separate compartments located between the pair of locations are relatively taut, so as to resist further expansion in a lateral direction, and where the portion of the pouch wall of the outer containment pouch located between the pair of locations includes an amount of slack, which is capable of further expansion in a lateral direction.

3. The system in accordance with claim 2 wherein the compartment deforming force includes a force applied by a user to both the outer containment pouch and the plurality of separate compartments in a laterally expansive direction.

4. The system in accordance with claim 2 wherein the pouch wall of the outer containment pouch includes an overlapping fold between said pair of locations, thereby producing said slack in the outer containment pouch.

5. The system in accordance with claim 2 wherein the pouch wall of the outer containment pouch is buckled between said pair of locations, thereby producing said slack in the outer containment pouch.

6. The system in accordance with claim 1 wherein at least a portion of the plurality of compartments extends outside of the outer containment pouch.

7. The system in accordance with claim 6 wherein the compartment deforming force includes a pulling force applied by a user to the portion of the plurality of compartments, which extends outside of the outer containment pouch, and which pulls the extended portion away from the outer containment pouch.

8. The system in accordance with claim 7 wherein the outer containment pouch includes a weak point which allows the portion of the outer containment pouch coupled to the extended portion of the plurality of compartments to tear away with the extended portion of the plurality of compartments when the deforming force is applied.

9. The system in accordance with claim 8, wherein the weak point of the outer containment pouch is formed by a perforated line formed in the pouch wall of the outer containment pouch.

10. The system in accordance with claim 1 wherein each of the plurality of compartments is substantially fully expanded and substantially sealed, so as to include a combination of at least one of one or more solids, one or more liquids, and one or more gases, and wherein the compartment deforming force includes a force which folds the plurality of compartments.

11. The system in accordance with claim 10 wherein folding the plurality of compartments decreases the volume of the interior storage space thereby increasing the internal pressure of the combination of at least one of one or more solids, one or more liquids, and one or more gases against the barrier material of the plurality of compartments.

12. The system in accordance with claim 1 wherein the weak point in the barrier material of at least some of the compartments includes a portion of the barrier material whose thickness is diminished.

13. The system in accordance with claim 1 wherein the weak point in the barrier material of at least some of the compartments includes a portion of the barrier material whose degree of elasticity is relatively greater than the other portions of the barrier material.

14. The system in accordance with claim 1 wherein the barrier material of at least some of the compartments includes a reinforcing material except in the area of said weak spot.

15. The system in accordance with claim 1 wherein the outer containment pouch separately includes at least one of a plurality of different medication components.

16. The system in accordance with claim 1 wherein the outer containment pouch includes a resealable opening through which one or more medication components can be added or removed.

17. The system in accordance with claim 16 wherein the resealable opening includes a threaded neck and a corresponding threaded cap.

18. The system in accordance with claim 16 wherein the resealable opening includes a pair of interlocking closure strips.

19. The system in accordance with claim 16 wherein the outer containment pouch includes measurement markings for determining the volume of medication components added.

20. The system in accordance with claim 16 wherein the medication component added is water.

21. The system in accordance with claim 1 wherein the amount of medication components in each of the plurality of compartments includes an amount corresponding to a single dose.

22. The system in accordance with claim 1 wherein one of the medication components reduces the side effects associated with another one of the medication components.

23. The system in accordance with claim 1 wherein at least one of the medication components includes a flavoring component.

24. The system in accordance with claim 1 wherein at least one of the medication components includes one or more colorants.

* * * * *